US007429728B2

(12) United States Patent
Enke

(10) Patent No.: US 7,429,728 B2
(45) Date of Patent: Sep. 30, 2008

(54) DISTANCE OF FLIGHT SPECTROMETER FOR MS AND SIMULTANEOUS SCANLESS MS/MS

(75) Inventor: Christie G. Enke, Placitas, NM (US)

(73) Assignee: STC.UNM, Albuquerque, NM (US)

( * ) Notice: Subject to any disclaimer, the term of this patent is extended or adjusted under 35 U.S.C. 154(b) by 0 days.

(21) Appl. No.: 11/360,872

(22) Filed: Feb. 23, 2006

(65) Prior Publication Data

US 2006/0138318 A1 Jun. 29, 2006

Related U.S. Application Data

(63) Continuation of application No. 10/804,968, filed on Mar. 18, 2004, now Pat. No. 7,041,968.

(60) Provisional application No. 60/456,269, filed on Mar. 20, 2003.

(51) Int. Cl.
*H01J 49/40* (2006.01)

(52) U.S. Cl. ..... 250/282; 250/281; 250/287

(58) Field of Classification Search ..... 250/281, 250/282, 287, 288, 292, 283
See application file for complete search history.

(56) References Cited

U.S. PATENT DOCUMENTS 2,642,535 A 6/1953 Schroeder
5,872,356 A 2/1999 Fischer

FOREIGN PATENT DOCUMENTS

| | | | |
|---|---|---|---|
| DE | 4308299 | A1 | 9/1994 |
| WO | WO8304187 | A1 | 12/1983 |
| WO | WO9939368 | A2 | 5/1999 |

*Primary Examiner*—Nikita Wells
*Assistant Examiner*—Johnnie L Smith, II
(74) *Attorney, Agent, or Firm*—Ellen M Gonzales; Gonzales Patent Services

(57) ABSTRACT

A distance of flight (DOF) approach to mass spectroscopy in which the resolution among the various ion masses is accomplished in space rather than time. A separate detector is associated with each ion mass resolution element. The DOF mass spectrometer can serve as one element in a tandem arrangement which has the capability to produce a full two-dimensional precursor/product spectrum for each bunch of ions extracted from the source. A "distance-of-flight" (DOF) mass analyzer is used in combination with time-of-flight (TOF) mass analysis for precursor and product dispersion. All the precursor ions can undergo a mass changing reaction simultaneously, while still retaining the essential information about the particular precursor m/z value from which each product ion m/z value emanated. Through the use of a two-dimensional detector, all the products ions from all the precursors can be detected for each batch of ions analyzed.

38 Claims, 8 Drawing Sheets

DISTANCE OF FLIGHT SPECTROMETER FOR MS AND SIMULTANEOUS SCANLESS MS/MS

CROSS-REFERENCE TO COPENDING PATENT APPLICATIONS

This application is a continuation of U.S. patent application Ser. No. 10/804,968, filed Mar. 18, 2004, which claims the benefit of U.S. Provisional Patent Application Ser. No. 60/456,269 filed Mar. 20, 2003.

BACKGROUND OF THE INVENTION

1. Field of the Invention

The present invention relates to a mass spectrometer for mass spectrometry (MS) based on ion flight distance in a given time being related to its mass-charge ratio. This has the advantages of time-of-flight mass spectrometry without the high-speed electronics normally required. The mass spectrometer may be in a tandem configuration to effect simultaneous collection of precursor and product spectra.

In its tandem mass spectrometer (MS/MS) configuration, the simultaneous production of the complete (MS/MS) spectrum for all the ions produced in the source provides an improvement in the efficiency and speed of mass spectrometric analysis as applied in biomedical research, drug delivery, environmental analysis and other applications.

2. Discussion of Related Art

Time-of-flight mass spectrometers are based on the difference in velocity attained by ions of different mass-to-charge ratios (m/z) when they are accelerated in a vacuum by an electric field. The common arrangement for the measurement of this velocity is to place a detector at the end of the flight path and determine the time required for the ion to reach the detector after acceleration. So, for a distance d between the acceleration region and the detector and a flight time of between the time of acceleration and detection t, the velocity v will be v=d/t. Since the distance is the same for all ions, their arrival times are different with the smaller m/z ions arriving first and the larger m/z ions later. This approach is called "time-of-flight" (TOF) mass spectrometry.

In the traditional linear TOF instrument, the ions would traverse a field free region at the end of which they would arrive at the detector in order of their m/z values. The detector signal intensity vs. time is recorded and presented as a mass spectrum.

Mass spectrometers can be devised to use either scanning mass-to-charge ratio (m/z) filters with a single detector (such as quadrupole or sector mass analyzers), batch m/z sorters with a single detector (such as the ion trap, the FTMS instrument or time-of-flight mass analyzers), or m/z spatial dispersion instruments with multiple detectors (such as a magnetic sector with linear detector array). When full spectral information is required, scanning filter instruments are the least efficient because they ignore huge portions of the sample ion beam while detecting the ions having the m/z value for which the filter is set at each instant.

Batch m/z sorting instruments are most efficient when the sample consumption is pulsed to coincide with the introduction of a new batch of sample ions. In cases where the sample comes in a continuous stream, as in chromatographic detection, the duty cycle of the instrument affects its efficiency. The duty cycle is the fraction of the time the instrument can convert the sample to ions that can be ultimately detected. The duty cycle of batch instruments that are analyzing a continuous sample stream can often be improved by a combination of continuous sample ionization and ion storage between ion batch introductions.

The utility of a mass spectrometric analysis can be significantly enhanced by performing two (or more) stages of mass analysis in tandem. A two-stage instrument is an MS/MS instrument, which performs two (or more) independent mass analyses in sequence. In the most frequently used mode of MS/MS, ions of a particular m/z value are selected in the first stage of mass analysis from among all the ions of various m/z values formed in the source. The selected ions (referred to as precursor ions) are energized, usually by collision with a neutral gas molecule, to induce ion dissociation. The ionic products of these dissociations are sorted into a product-ion mass spectrum by the second stage of mass analysis.

Tandem mass spectrometers are composed of multiple mass analyzers operating sequentially in space (Reinhold and Verentchikov 2002) or a single mass analyzer operating sequentially in time. Between the two stages of mass analysis, the ions must be subjected to some mass changing reaction such as collisional dissociation so that the succeeding mass analyzer has a different distribution of m/z values to analyze. The distribution of ions produced by the sample is called the precursor mass spectrum and is the same spectrum produced in non-tandem instruments. For each of the precursor ion entities, there will be a distribution of reaction product ions called the product ion spectrum.

Tandem mass spectrometers provide a great enhancement in detection specificity because ions appearing at a combination of precursor and product m/z values are more specific to a particular analyte than just the precursor m/z value. When the ion intensity for all combinations of the two m/z values is measured, a 3-dimensional array of data (precursor m/z vs. product m/z vs. intensity) is produced. From such a data set, mixtures of ions can be resolved without prior separation of their molecules and a great deal of structural information about individual compounds can be obtained. The development of MS/MS has had a huge impact on the analytical usefulness of mass spectrometry in all areas of its application.

A considerable amount of sample and time can be required to obtain the full MS/MS spectrum (intensities of all the product m/z's for each precursor m/z value). If the two mass analyzers are scanning devices, the ion intensity at every precursor/product m/z combination must be measured separately. This compounds the problem of sample use efficiency inherent in all scanning instruments.

If the two mass analyzers are the same device used sequentially (as with ion trap and FTMS instruments), ions having a particular m/z value in the precursor mass spectrum are isolated, and then reacted, and then the mass spectrum of the product ions is obtained (Roussis 2001). This process must be repeated for each m/z value in the precursor mass spectrum. The time required for this sequence compounds the duty cycle inefficiency of batch instruments. For full single MS spectrum generation, batch mass analyzers (time of flight mass spectrometry (TOF), ion trap mass spectrometry (ITD), Fourier transform mass spectrometry (FTMS), etc. have higher sample utilization efficiency and faster spectral generation rates than mass filter analyzers (linear quadrupoles, and sector analyzers).

ITD and FTMS are both batch techniques in that ions are taken in "batches" for analysis and all ions in a batch can be detected so that a full spectrum is generated for each batch. When used independently for MS/MS, all ions in a batch but those with the desired m/z are ejected, the selected ions undergo collisional fragmentation in the same cell, which fragmentation generates the ions seen in the product spectrum. These techniques are often called "tandem in time" since the same cell is used for precursor selection and product ion spectrum generation. The ITD uses RF voltages for ion containment within the cell and the FTMS uses a strong magnetic field. They also have different methods for ion detection.

Sample utilization efficiency is the fraction of the sample that can be converted into detectable ions. Sample utilization efficiency is adversely affected by the rejection of ions of a sample through the use of mass filters or the inattention of the instrument to the introduction of sample because it is doing something else. An example of the latter is the ITD that may be doing precursor selection and product spectrum generation while new sample is still being introduced to the ion source or sent to waste.

For many applications of mass spectrometry, desired information needs to be provided while using as small an amount of sample as possible. The range of applications and the number of days spent culturing cells and the size of an animal required for drug metabolism tests all depend on how small an amount of sample is needed to provide the desired information. This is why, for full spectrum generation, higher sample utilization efficiency and faster spectral generation rates are preferable. Regarding spectral generation rate, the preferred mode of sample introduction is through liquid chromatography, a technique in which the sample components are sorted according to their retention time on a column through which they pass. As the various compounds leave the column and flow into the source each is present for some 10's of seconds or less. This is then the amount of time available to get all the information about an eluting compound. Further, compounds often overlap in their elution. Rapid spectral generation may enable the generation of each compound's elution profile and thus allow overlapping compounds to be separately identified.

A mass filter mass analyzer (such as a quadrupole) allows transmission of ions having only a narrow range of m/z values at a time. To obtain a spectrum, there must be a steady supply of ions to the mass filter while the mass filter is scanned over the range of m/z values of interest. It is wasteful of ions relative to the "batch" analyzers TOF, ITD, FTMS) for which all ions in a batch can be detected and assigned the appropriate m/z value.

The great success of the tandem combination of quadrupole and time-of-flight mass analyzers (an instrument called a Q-TOF) is due to the ability of the time-of-flight analyzer to produce product spectra at such a high rate that the full MS/MS spectrum can be obtained in one rather slow sweep of the quadrupole mass analyzer m/z setting. The duty cycle problem of the time-of-flight mass analyzer can be offset by introduction of an ion storage device immediately preceding it (Van Fong, 2001). Still, the poor sample utilization efficiency of the scanning quadrupole device and the relatively long time to scan through the range of desired precursor m/z values remain as limitations of this very popular instrument.

Tandem TOF instruments can reduce this problem to some extent (Barofsky 2002), though they are still only capable of generating one product spectrum for each selected precursor m/z value selected. The advantage of the TOF-TOF arrangement over the Q-TOF is principally the faster access to specific precursor m/z values and potentially faster generation of the full MS/MS spectrum.

Several researchers have conceived variations on the time-of-flight mass spectrometer in which all the precursor ions are subject to the fragmentation mechanism without preselection and the product mass is then determined by subsequent acceleration. The identification of the product ion's precursor mass is then made by the time difference in the detection of the ionic and neutral products of the fragmentation (Alderdice, Derrick et al. 1993), or by the time difference between the time of fragmentation and the time of product detection (Wollnik 1993). These approaches are very efficient in sample utilization, but have the problem that the ion flux must be maintained low in order to make the required time correlations. Such a low ion flux is inconsistent with application of the device for chromatographic detection and rapid screening of complex mixtures.

Conventional MS/MS instruments have no way to keep the information about the precursor m/z once the ion has been fragmented. Therefore, one must fragment ions of only one m/z value at a time, passing the fragments of the selected m/z value ions on to the second stage of mass analysis. Regardless of the type of mass analyzer used for the first stage of MS in an MS/MS instrument, it is therefore used as a mass filter in that only ions of only a narrow range of m/z values are accepted from it at one time. This is wasteful of sample because to obtain the product spectrum from ions that have other m/z values, one must repeat the experiment again to produce ions from each different precursor m/z value. If, while the desired set of precursor values are being selected, fragmented and analyzed, the sample composition in the source is changing (as could be the case with liquid chromatograph introduction) this adds further complication to the data analysis.

A vision of many researchers has been to obtain the full MS/MS spectrum without use of any scanning mass analyzers, producing, for each batch sample ions, the full 3-dimensional data array (McLafferty 1983, and Conzemius and Svec 1990). It would be desirable to provide a device that will do just that.

Time-of-flight mass analyzers have been previously used for product ion dispersion in MS/MS instruments. In such instruments, the first mass analyzer has sometimes been a quadrupole (Bateman and Hoyes 2000; Whitehouse and Andrien 2001), TOF, sector and other forms of mass analyzers have also been used for the selection of precursor ion m/z values. As discussed previously, ions of only a narrow range of m/k values are allowed to undergo the mass changing reaction at a time in such systems. It would be advantageous to provide a device in which each whole batch of ions would undergo fragmentation together and then be dispersed in such a way that the precursor m/z information is retained for each product ion detected.

Deconvolution is the resolving of the signals from components whose chromatographic peaks overlap into the signals each compound would have generated if it were present alone. This can be accomplished with overlapping chromatographic peaks only if the spectral information is obtained at the rate of 20 to 50 times per peak width of the eluting compounds. Until now, this has only been accomplished for 2-d (intensity vs. m/z) mass spectra. An aspect of this invention is the availability of the full 3-d spectral data on a time scale suitable for chromatographic deconvolution. The additional dimension provided by the MS/MS data should make deconvolution still more effective for complex mixture analysis. For present liquid chromatography and MS/MS, it is desirable to obtain the full 3-d MS/MS information several times every second or even more often. As improvements in chromatography shorten the peak widths, rapid spectral generation will become even more important. Another aspect of the invention with respect to chromatographic deconvolution is that all the MS/MS data are collected for the same batch of ions from the source so that there will be no difference in chromatographic time among elements of the data used in the deconvolution step. This lack of spectral skew is very valuable in the application of deconvolution algorithms.

SUMMARY OF THE INVENTION

One aspect of the invention resides in providing such a device that fulfills what was previously mentioned as desired. Such a device is realized in accordance with the invention by using a distance-of-flight (DOF) mass analyzer in combination with time-of-flight (TOF) mass analysis for simultaneous dual axis dispersion of precursor ion and product ion m/z values to provide 3d specified data.

Conventional TOF mass analyzers have been used for product ion dispersion in combination with quadrupole, TOF, sector and other forms of mass analyzers that perform the selection of precursor ions by their m/z values. In such conventional systems, ions of only a narrow range of precursor m/z values are fragmented, and their fragments dispersed and detected at a time.

In accordance with the present invention, all the precursor ions undergo the m/z changing reaction (generally, but not exclusively, fragmentation) simultaneously, but the DOF dispersion contains the information about the precursor m/z value from which each product ion emanated. Through the use of a two-dimensional detector (X-Y or X-time), all the products from all the precursors can be detected for each batch of ions analyzed.

The velocity attained by ions may be determined by the distance traveled in a given amount of time. In this case, the time of flight between extraction and orthogonal acceleration is the same for all ions, but the distance traveled is different with the ions having lower m/z values traveling further than those with higher m/z. This approach has not heretofore been suggested or implemented, perhaps because it would require a separate detector for each increment of ion travel. Now, however, with the advent of inexpensive detector arrays, this approach is quite practical and it offers some distinct advantages. This method of mass analysis is henceforth called "distance-of-flight" (DOF) mass spectrometry.

The principal advantage of the DOF approach over the TOF approach is that the resolution among the various ion masses is accomplished in space rather than time. This eliminates the need for high-speed electronics and counting systems to determine the number of ions arriving at the detector at a particular time. Instead, there is a separate detector for each ion mass resolution element. Each detector can be of the integrating type, accumulating the ion charge over any reasonable number of ion batches to improve detection limit, precision, and dynamic range. The detector signal intensities are presented in order from the most distant detector element to the nearest to produce a mass spectrum. Alternatively, each detector can provide an independent signal thus providing a measure of the ion intensity of one or more mass resolution elements as a function of time. This latter mode would be particularly useful for detection in high-speed chromatography.

The DOF mass spectrometer can serve as one element of an MS/MS instrument which has the capability to produce the full three-dimensional intensity vs. precursor/product m/z spectrum for each bunch of ions extracted from the source. A "distance-of-flight" (DOF) mass analyzer is used in combination with time-of-flight (TOF) mass analysis for precursor and product dispersion. Alternatively, the DOF mass analyzer can be used with dispersion in a second dimension to produce MS/MS spectra.

All the precursor ions can undergo the mass changing reaction simultaneously, while still retaining the essential information about the particular precursor m/z value from which each product ion emanated. Through the use of a two-dimensional detector (distance of flight and time-of-flight or a 2-dimensional array), all the product ions from all the precursor ions can be detected for each batch of ions analyzed.

BRIEF DESCRIPTION OF THE DRAWINGS

For a better understanding of the present invention, reference is made to the following description and accompanying drawings, while the scope of the invention is set forth in the appended claims:

DETAILED DESCRIPTION OF THE INVENTION

Figure 1:
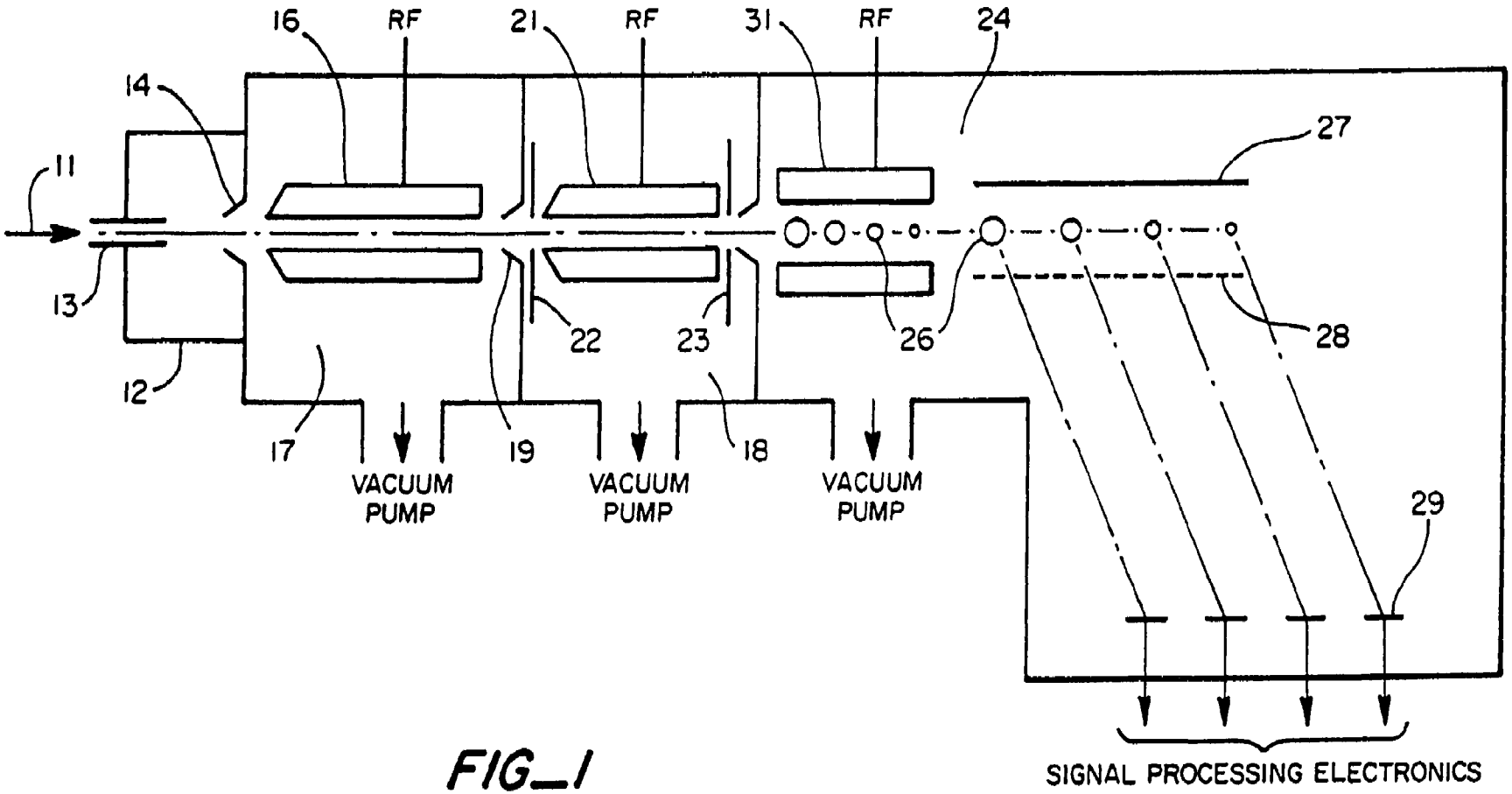
FIG. 1 shows a schematic diagram of a DOF spectrometer in accordance with one embodiment of the invention.
Figure 2:
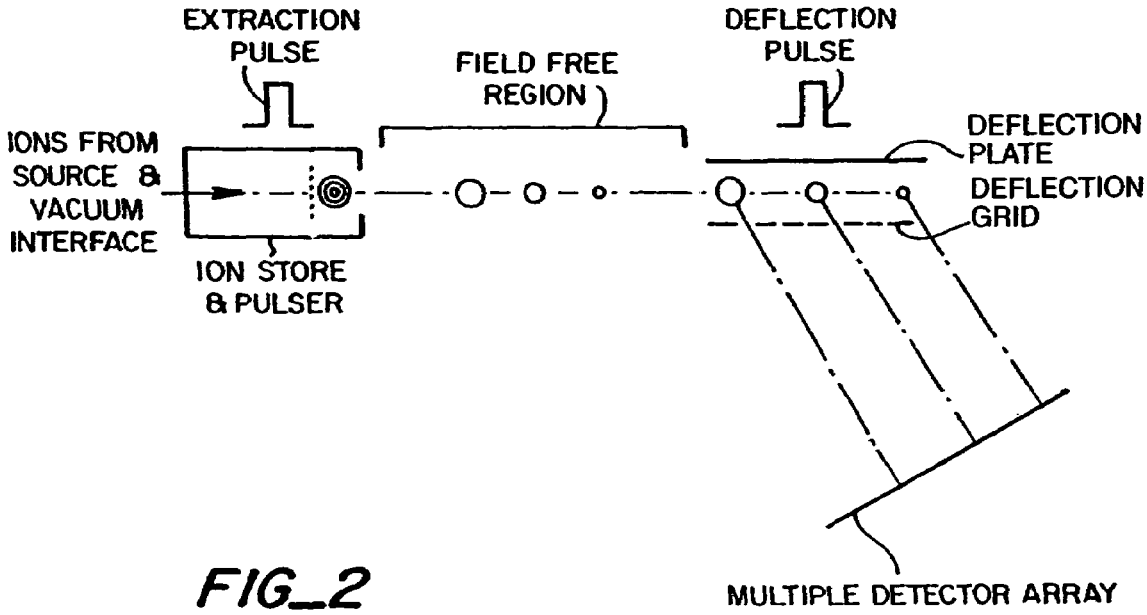
FIG. 2 is a schematic representation of ion extraction and detection.

Depicted in schematic FIGS. 1 and 2 is an implementation of a distance-of-flight mass spectrometer. Sample 11 is introduced in liquid form into an electrospray ionization (ESI) apparatus 12. Ions are formed in the region between the end of the sample introduction capillary 13, and the first inlet aperture 14. In addition to the ions from the electrospray, molecules from the gas contained in the ESI region also enter the entrance aperture. The ions entering the entrance aperture are separated from the accompanying gas by the use of an RF ion guide 16 composed of parallel rods or stacked discs. These devices provide containment field for the ions while allowing the gas to be pumped away by the vacuum pump attached to this first vacuum chamber 17. Ions are transmitted from the first vacuum chamber 17 to the second vacuum chamber 18 through the interchamber orifice 19, being guided through said orifice by electric fields, gas flow, or both. The second vacuum chamber also contains an RF ion containment device 21 composed of parallel rods or stacked discs. This device is used to store ions introduced from the first vacuum chamber, provide possible further reduction in gas pressure through the attached pump, and to provide pulses or bunches of ions for the following ion flight path. Ion pulsing can be accomplished by creation of a longitudinal potential well within the storage device by applying DC voltages to grids 22 and 23 and then changing the longitudinal fields so as to move a pulse of stored ions out of the exit end of the device and into the following vacuum chamber 24.

The batch of ions from the ion purser enters a field-free region in the third vacuum chamber. The pulse of ions 26 may contain ions of several m/z values. This is illustrated by the different size circles. In the case of a constant extraction pulse from the preceding ions store and pulse apparatus, the ions will all have roughly the same energy. Their velocity will then be a function of their m/z with the lower value m/z ions having a higher velocity than ions with higher values of m/z. By the time the ions reach the orthogonal field extraction plate 27, they will be dispersed according to their m/z values. An extraction pulse is then applied between the extraction plate 27 and grid 28 to provide an orthogonal force to the ions in this region. The timing of the extraction pulse relative to the ion pulsing from the ion store and pulse apparatus is carefully controlled so that the ions of interest are in the orthogonal extraction region at the time of the extraction pulse. If ions of differing m/z have the same axial kinetic energy from the pulser, they will have roughly parallel paths as they travel through the extraction grid and beyond as shown. Once through the grid, the ions are detected by an array of detectors 29 located on the other side of the grid. The position of the detectors is linearly related to the position of the ions where they are deflected. The angle of the detector array is a designer option. The ion intensity of ions with different m/z ratios will be detected by different elements of the array. Interrogation of the array elements will then provide the information from which a mass spectrum can be constructed.

It will be understood that this apparatus can be used with other suitable sources of sample ions both already known and yet to be developed. These sources include atmospheric pressure matrix-assisted laser desorption ionization from solid and liquid samples, and other forms of ion desorption, nanospray ionization of liquid samples and other variations on electrospray ionization, atmospheric pressure chemical ionization of gaseous samples, glow discharge ionization of gaseous samples and other forms of gaseous ionization methods, and vacuum methods of ionization including electron impact ionization, chemical ionization, matrix-assisted laser desorption ionization.

It will also be understood that the introduction of ions into the ion store and pulser apparatus may be accomplished by a variety of known means of ion guiding and pressure reduction. This would include RF containment devices composed of parallel rods or stacked discs, ion lenses and other ion optical elements. Similarly, the ion store and pulsing apparatus may be composed of parallel rods, a cylindrical ion trap, or other similar devices in which ions can be introduced, stored with minimal loss, and pulsed in a batch for succeeding mass analysis. The extracted ions may be given essentially the same energy, the same momentum, or an m/z-dependent energy so long as ions with different m/z values leave the pulsing apparatus with different velocities.

In one embodiment the normal operation of the distance-of-flight mass spectrometer will not include a collision or other fragmentation cell between the ion pulser and the orthogonal extraction plate and grid. This region will be largely field-free, but may contain ion optic elements for ion containment or focusing, or it may contain a fragmentation cell that is either operative or not operative.

The orthogonal extraction pulse generator will generally be of constant amplitude throughout the pulse. However, as with the extraction from the ion store and pulser apparatus, a time-dependent extraction field may be applied. The timing of the orthogonal extraction pulse relative to the ion extraction pulse and the bunched ions is controlled by precision timing circuits. The extraction pulse is applied when the ion bunch is opposite the deflection plate 27.

Regarding the detectors, suitable ones for use with the invention are described in the October 2003 issue of American Laboratory in an article by Barns, Hieftje, Denton, et al describing a simple ion charge detection device and demonstrates its application in a mass spectrometer. An array of thirty-one faraday cups with associated circuitry is illustrated. Array detectors for sector instruments which provide spatial dispersion of ions by means of magnetic fields are commercially available and such array detectors are likewise suited for use with the invention. Burle Industries of Sturbridge MA makes an imaging detector with electron multiplication via a microchannel plate that has been demonstrated to work for ion detection in mass spectrometry and is suited for use with the invention.

There are important features of a distance of flight mass spectrometer (DOF-MS) in accordance with the invention. All ions are deflected toward the detector at the same time but travel different distances in that time. The distance traveled by each ion from the exit of the store and pulse device to the point of deflection can be calculated as follows: For an ion accelerated $\iota_s$ meters in a source with a field of E V/m, the ion acceleration $\alpha$ is.

$$a = \frac{dv}{dt} = \frac{Eq}{M} \tag{1}$$

Integrating to get the ion velocity, we get $$\int_0^v dv = \frac{Eq}{M}\int_0^t dt \tag{2}$$

and $$v = \frac{Eqt}{M} \tag{3}$$

where M is the ion mass in kilograms and q is the ion charge in coulombs. The distance the ion travels in the source in a given time is obtained by integrating the equation $$v = \frac{dl}{dt} \tag{4}$$

in the form $$\int_0^l dl = \int_0^t v\,dt = \frac{Eq}{M}\int_0^t t\,dt \tag{5}$$

to obtain $$l = \frac{Eqt^2}{2M} \tag{6}$$

The ion leaves the source at time $t_s$ seconds with a velocity $v_s$ meters per second. Using these terms in the previous equation we get $$t_s = \left(\frac{2l_sM}{Eq}\right)^{1/2} = \left(\frac{1.04\times10^{-8}\times2l_sm}{Ez}\right)^{1/2} \tag{7}$$

where ion mass is now changed to Thomsons m and the ion charge becomes number of electron charges z. The velocity of the ions leaving the ion acceleration region and entering the field-free flight region is $$v_s = \frac{Eq}{M}t_s = \left(\frac{2l_sEq}{M}\right)^{1/2} = \left(\frac{2l_sEz}{1.04\times10^{-8}m}\right)^{1/2} \tag{8}$$

The deflection pulse is applied at time $t_{def}$. The distance $d_{def}$ the ion has traveled from the exit of the pulser at the time of deflection is $$d_{def} = v_s(t_{def} - t_s) = \left(\frac{2l_sEz}{1.04\times10^{-8}m}\right)^{1/2}(t_{def} - t_s) \tag{9}$$

The angle to which the ions are deflected depends upon the ratio of their axial acceleration within the pulser to their lateral acceleration in the deflection region. Following the same arguments which resulted in Equation (8), the velocity in the orthogonal direction will be $$v_o = \left(\frac{2l_oE_oz}{1.04\times10^{-8}m}\right)^{1/2} \tag{10}$$

The tangent of the angle of ion trajectory following orthogonal acceleration will be $$\bar{v}_o/\bar{v}_s = \left(\frac{l_oE_o}{l_sE_s}\right)^{1/2}$$

which is independent of m/z.

Thus, as seen in FIG. 1, the same spatial relationship among ions with various m/z ratios that existed at the time of deflection is maintained to the moment of deflection. Thus each detector element in the detector array detects a different precursor m/z value. The detector elements can count ion arrivals or integrate ion charge over many extractions from the store and pulser apparatus. Integration of many extractions will result in improved signal-to-noise ratio. Also, if the detector elements can be interrogated during the integration and the saturating elements can be read and cleared, the dynamic range of useful ion intensities can be increased.

First assume that the ions have been bunched to the same point in space, and that they all have negligible kinetic energy. If they traverse an attractive field $V_{ext}$ upon extraction, they will achieve a velocity $$v = \left(\frac{2ezV_{ext}^{z}}{M}\right)^{\frac{1}{2}} \tag{11}$$

where e is the charge on an electron, M is the mass of the ion in kg and z is the number of unit charges on the ion. The velocity v will be in meters per second. Consider an ion of mass $m_i$ Daltons and $z_i$ charge that has traversed a field of $V_{ext}$. Its velocity will be $$v = \left(\frac{2ez_iV_{ext}^{z_i}}{m_1}\right)^{\frac{1}{2}}(2\times 1.6x10^{-19}\times 6.02x10^{26})^{\frac{1}{2}} \tag{12}$$

for an ion of 1000 Daltons, unit charge, and an extraction field of 500 V, $v=9.83\times10^3$ meters per second. This is called the constant energy extraction method because all the ions extracted have essentially the same kinetic energy. Ions extracted from the store and pulser device then enter an essentially field free region in which their different velocities will carry them different distances along the path at any given moment in time.

Constant Energy Extraction

For the case of constant energy extraction for which an extraction pulse is applied until all ions have left the source, the position $d_{def}$ along the flight path for each value of m/z at the time of its deflection $t_{def}$ is $$d_{def} = 1.39x10^4 t_{def}\left(\frac{V_{ext}z_i}{m_i}\right)^{\frac{1}{2}} \tag{13}$$

Consider a mass spectrometer which has a desired range of m/z from 100 to 2000 daltons. For such an instrument, $d_{def}$ for an ion of m/z 100=4.47×$d_{def}$ for an ion of m/z 2000. In other words, the m/z 2000 detector will be located 4.47 times farther along the flight path than the detector for ions of m/z=100. The position of each ion's point of deflection has a square-root relation to the m/z of that ion which means that the distance between detectors that detect adjacent unit m/z values will be closer together towards the higher m/z end of the detector array. This relationship is illustrated in the plot of FIG. 3.

Figure 3:
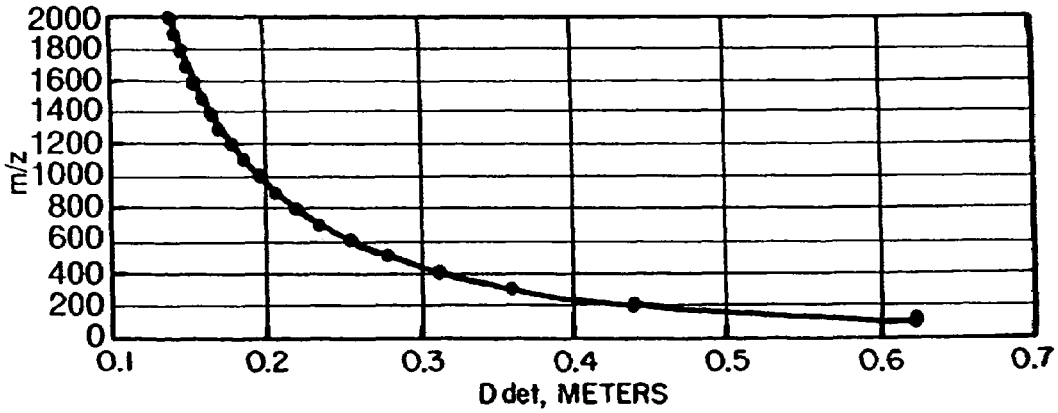
FIG. 3 shows a graphical representation of distance of flight versus ion m/z when using constant energy extraction.

This plot of FIG. 3 used the values of 500 V for V and 20 μs for the extraction time. Changing these values only changes the scale of the distance axis, not the general shape of the curve. In this example, detectors spread over roughly half a meter will detect all the m/z values from 100 to 2000. The slope varies from 0.13 cm/Dalton at m/z 200 to 0.004 cm/Dalton at m/z 1900. Detectors separated by 40 microns will provide unit m/z resolution, even at the high m/z end of the scale. They may be placed further apart as the distance from the source increases. It will be understood that other detector dimensions can be implemented through the use of different voltages and distances according to the above equations and arguments.

Figure 4:
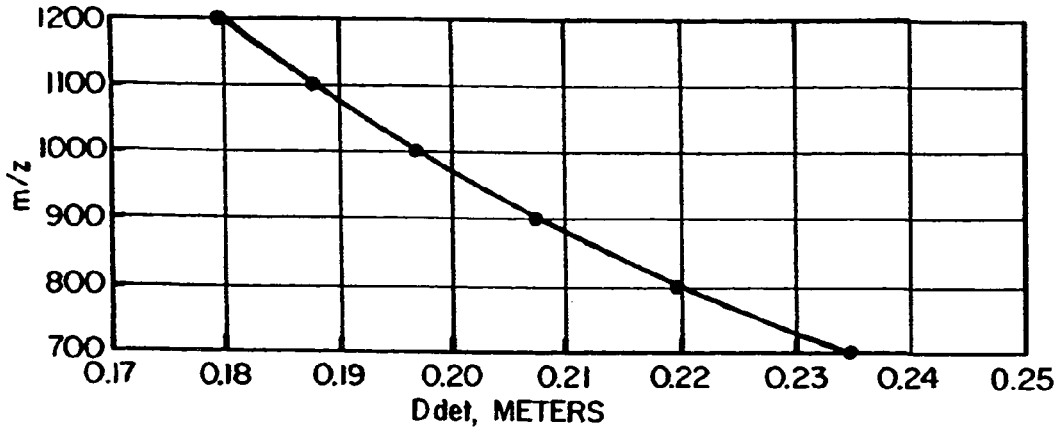
FIG. 4 shows a graphical representation of an expanded section of FIG. 2, useful for electrospray ionization analysis of peptides.

A somewhat more practical implementation might be for an instrument with a more limited m/z range for a given experiment. A range of 700 to 1200 Daltons, for instance, would be very useful for the electrospray ionization analysis of peptides. A plot for this application is shown in FIG. 4. This plot is just an expanded section of the plot of FIG. 3. Over this m/z range, the detector length between adjacent unit m/z values varies from 80 microns at m/z 1200 to 170 microns at m/z 700, or just a little over a factor of 2 change from one end of the scale to the other. The total length of the detector would be 5.6 cm. If the detector were an array containing 700 elements on an 80 micron spacing, unit m/z resolution would be obtained over the m/z range from 700 to 1200 Daltons.

Figure 5:
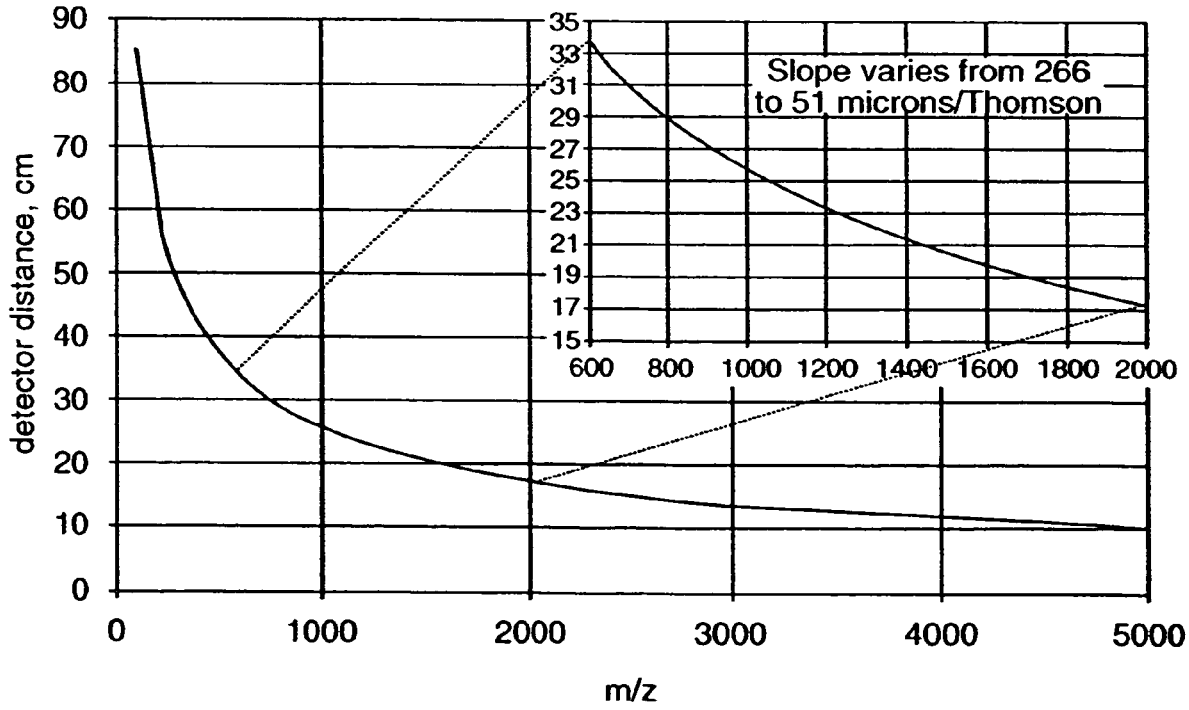
FIG. 5 shows a graphical representation of ion flight distance vs. m/z with a constant energy extraction field applied.

For a constant field extraction, the distance traveled is a non-linear function of the precursor ion m/z as exemplified by FIG. 5, which shows the ion flight distance vs. m/z with a constant extraction field. As previously derived and calculated, this results in a potentially wide variation in the m/z resolution as a function of m/z. This non-linearity can be undesirable because achievement of the desired resolution in the higher m/z range can lead to an unnecessarily large detector array when ions of much smaller m/z value are also to be detected.

Linearized and Compacted Extraction

Another possibility for linearizing the relationship between m/z and distance and for reducing the length of detector needed to cover a given range of m/z values is to use a non-linear extraction. Starting with a lower extraction voltage, the extraction voltage is increased with time.

The extraction voltage ramp should be completed before the ions at the high end of the desired m/z range have left the extraction region. Ions with lower values of m/z will experience less acceleration and thus have a lower velocity than with constant energy extraction and ions with higher values of m/z will experience greater extraction acceleration and thus achieve a higher velocity than they would have with constant energy extraction. This will compress the range of velocities from the lowest m/z to the highest and potentially linearize the relationship for all values of m/z. For a wide m/a range instrument, this would likely be the most desirable implementation.

Figure 6:
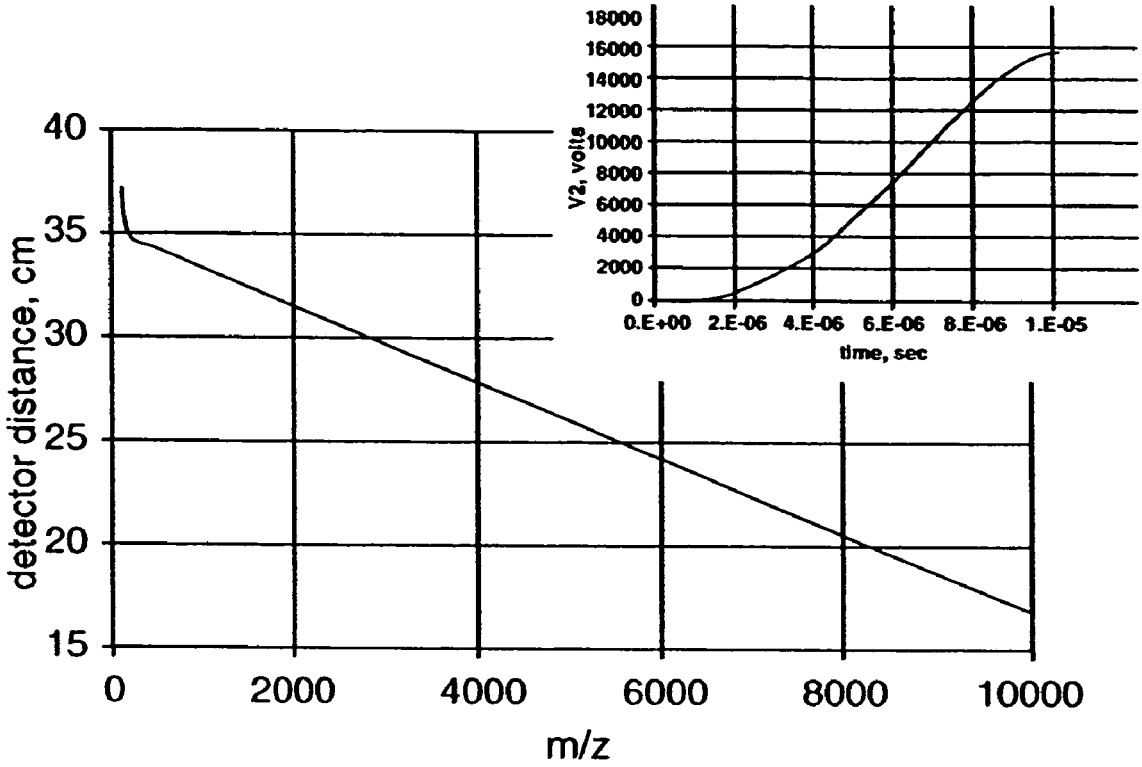
FIG. 6 shows a graphical representation of two-field, time variant extraction of ions designed to achieve a linear relationship between distance of flight and m/z.

An alternative way to attain linearization and compaction of the m/z values as a function of distance of flight is to apply an added extraction region just beyond the extraction region contained in the store and pulser device. The field strength in this second extraction region would increase with time following the onset of extraction so that the ions with higher values of m/z emerging from the source later than ions with smaller m/z are subjected to a higher extraction field than the lower m/z ions that preceded them. The inset in FIG. 6 shows the possible time-dependent value of such an added extraction voltage. The time-dependence shown will result in a linear relationship between the detector distance and the charge to mass (m/z) values of the detected ions.

As shown in FIG. 6, the application of a shaped extraction pulse to the second field region in a two-field extraction source can yield a linear relationship between precursor m/z and flight distance over a very wide m/z range. In the implementation shown, the first field is 200 v/cm over 1 cm. The voltage creating the second field increases with time from the beginning of the extraction as shown by the inset in FIG. 6.

The time of the deflection pulse is 20 μs. The slope is constant at 18 microns/Thomson. Both FIGS. 5 and 6 were derived from theoretical calculations. It will be understood that other combinations of initial fields and ramped field contours may be used to achieve the equivalent effect.

Alternatively, the shaped extraction pulse may be varied to present any fraction of the mass range across the region of the detector array. In this way, the instrument may dynamically select the m/z range and resolution achieved by a fixed detector array.

It is also likely that a continuously increasing extraction energy may provide some spatial focusing of the spectrum (Kovtoun and Cotter 2000). Ions that are further back in the source and thus have a longer flight path would be given a bit more acceleration and thus, by the time of the detection pulse, be able to catch up with ions of the same m/z that started closer to the front of the source.

Constant Momentum Extraction

In an alternative method of ion extraction, a very brief extraction pulse is applied to the ion bunch in the store and pulser device such that they all receive the same acceleration force. The extraction pulse must conclude before any of the ions have left the acceleration region. In this "constant momentum" acceleration method, the ions will achieve a velocity $$v = \frac{Et_p ez}{m} \tag{14}$$

where E is the acceleration field strength in volts per meter and $t_p$ is the duration of the extraction pulse. The velocity of an ion of $m_i$ Daltons will be $$v = \frac{Et_p z_i}{m_i} \times 9.63x10^7 \tag{15}$$

meters per second. Consider an ion of 1000 Daltons carrying a single charge and subjected to an extraction field of 5000 V/cm for 100 ns. Its velocity will be 48.15 meters per second. Ions extracted from the source then enter an essentially field free region in which their different velocities will carry them different distances along the path at any given moment in time.

For the case of constant momentum extraction for which very short pulses are applied that are so short that none of the ions have left the source by the time the pulse is over, the ions are in a sense administered an energy burst that causes the ions to leave the source on their own after the pulse has ended. The momentum is a product of charge times the field strength. By providing constant momentum, the same amount of accelerating force is applied to each ion. The detector distance for ions may be calculated using the following equation:

$$D_{det} = 9.63x10^7 t_{oe}\left(\frac{Et_p z_i}{m_i}\right) \tag{16}$$

Figure 7:
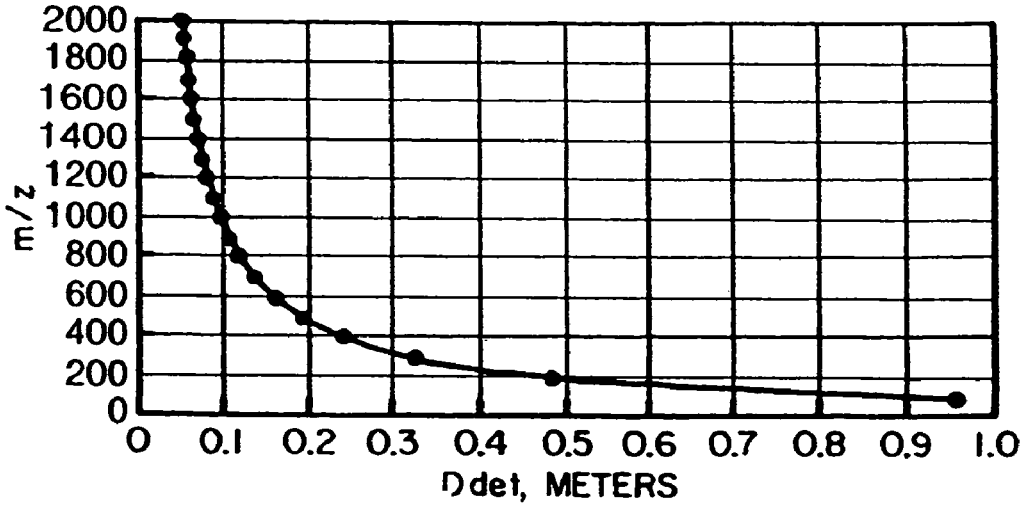
FIG. 7 shows a graphical representation of distance of flight versus ion m/z when using constant momentum extraction.

For an instrument with a m/z range of 100 to 2000 daltons, $D_{det}$ for ions with m/z 100=20×$D_{det}$ for ions with m/z 2000. In this instrument, there is a reciprocal relationship between the distance at the point of detection and the m/z value of the ion detected. This is shown in the plot of FIG. 7 for the range of 100 to 2000 Daltons. The parameters used in this plot were 5,000 V/cm for E, an acceleration pulse of 100 ns, and an extraction time of 20 μs. Again, a change in these parameters will affect the distance scale, but not the shape of the overall curve. Comparing FIGS. 3 and 7, one can see that the reciprocal relationship produces a greater difference in slope over the m/z range plotted than the square root relationship and thus the constant energy acceleration implementation might be preferred.

Figure 8:
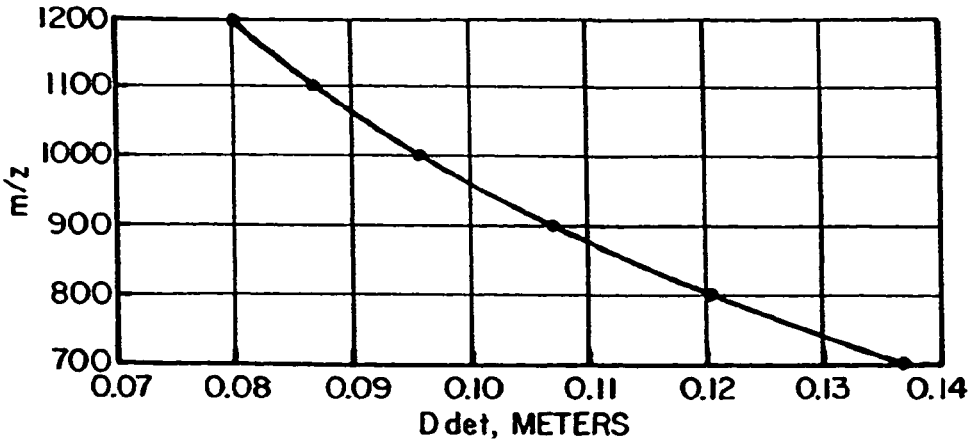
FIG. 8 shows a graphical representation as in FIG. 7, but for a limited m/z range instrument, which uses the same m/z range as that of FIG. 4.

However, this slope difference is minimized in the case of a limited m/z range instrument. The plot for such an instrument is shown in FIG. 8. This uses the same m/z range as the plot of FIG. 4. In this case, the slope is 67 microns per Dalton at m/z 1200 and 200 microns per Dalton at m/z 700. The total length of the detector is 5.7 cm.

The foregoing calculations and examples show clearly that a DOF mass spectrometer is entirely practical in implementation. Further, there are many potential advantages to such an instrument. It is simple in construction. It avoids the need for high-speed electronics in the detection system. The detectors could be integrating devices for the accumulation of the results of many ions extractions from the source or instantaneous detectors for the continuous plotting the intensity of each m/z value vs. time. It could be very compact. For targeted analyses, only a few detectors, located at the distances for the m/z values of interest could be employed, further simplifying the instrument. However, probably the most exciting aspect of this invention is its potential as a means of m/z separation in an MS/MS instrument. For MS/MS capability, an ion fragmentation cell, an orthogonal extraction TOF section and a two-dimensional detection system need to be added.

The Application of DOF-MS in an MS/MS Instrument

Figure 9:
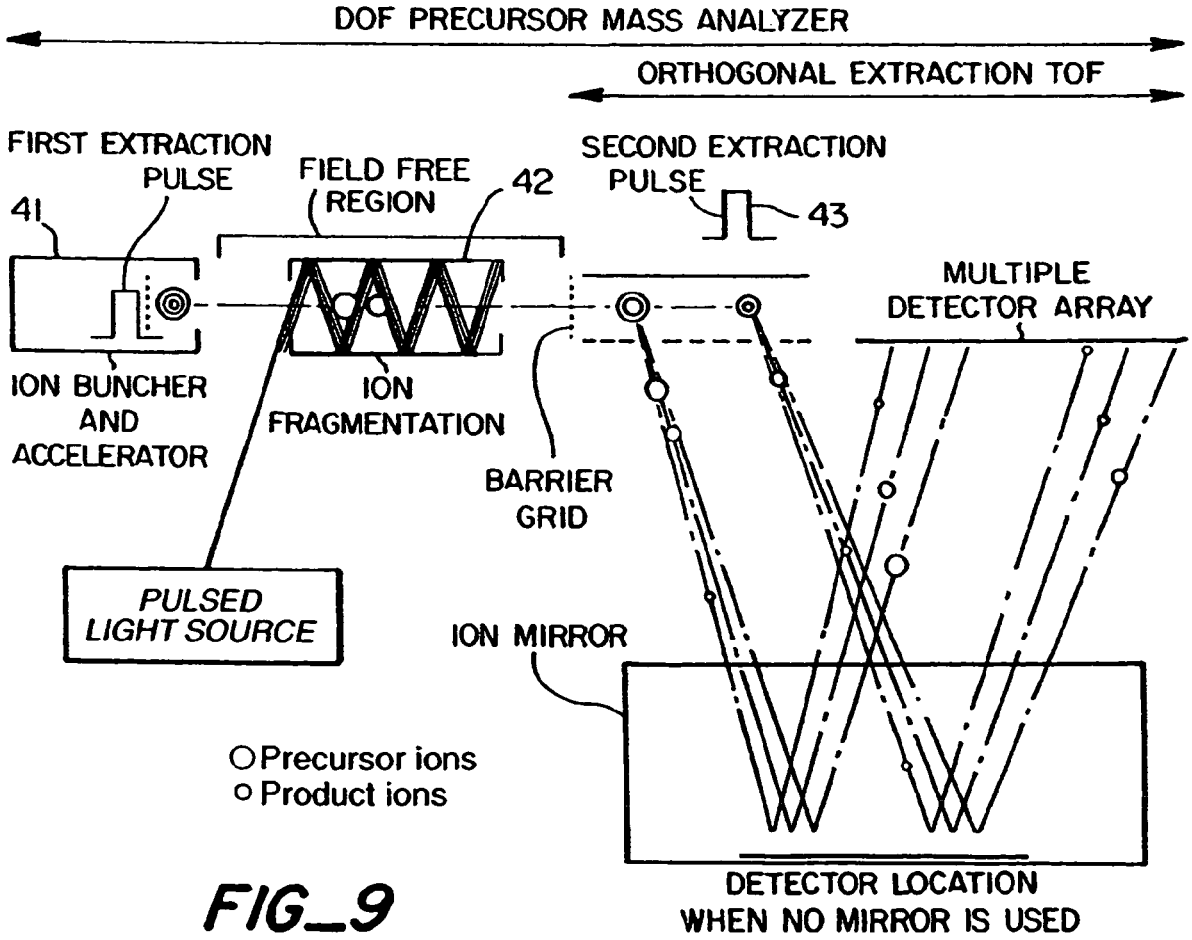
FIG. 9 shows a schematic representation of a DOF-TOF mass spectroscopy instrument with time-sensitive array detector and with photodissociation in accordance with the invention.

A schematic diagram of a combination DOF-TOF mass spectrometer instrument in accordance with the invention is shown in FIG. 9. Precursor ions of the sample molecules are extracted from the ion buncher and accelerated by the sudden application of an extraction pulse in the extraction region 41. The various methods of ion production and collection in the buncher are not shown in this drawing as a variety of well-known options are available including that shown in FIG. 1. Buncher options include quadrupole and linear ion traps. The ions are given a m/z-dependent velocity by any of the several methods mentioned previously. However, in order to accomplish MS/MS, the precursor ions must undergo fragmentation to form product ions.

The precursor ions in an ion bunch are fragmented, as for example by application of an intense, energetic beam of light, timed to coincide with the appearance of a bunch of ions in the fragmentation region. The fragmentation region is in the form of a cell 42 with internal reflecting surfaces to maximize the probability of photo excitation of the ions. When an ion spontaneously dissociates, the fragments retain the same direction and velocity as the precursor ion (except for the minor conversion of the bond energy into a change of the kinetic energy of the product ions). Therefore, the product ions enter the next stage of mass analysis with the same velocity as their precursor ions but with a different (generally lower) m/z. It is also understood that other methods to energize the precursor ions can be used. These include collisional dissociation (with single collisions) and electron excitation.

Orthogonal acceleration time of flight is employed to sort out the product ions according to the product m/z values (Chemushevich, Ens et al. 1999; Cotter 1999). Part way along the DOF flight path, but after the fragmentation process, the ion beam is subjected to a second extraction pulse 43 that is orthogonal to the DOF flight path. This causes ion fragments of different m/z to travel at different velocities. Ion motion from this point is a velocity vector composed of the original linear DOF velocity vector (precursor m/z dependent) and the orthogonal velocity vector (product m/z dependent) imposed by the second extraction pulse. The mathematical details of how this sorting occurs are covered in the next section.

Theoretical Analysis of Ion Trajectories

The total flight time to detection, $t_{det}$, is the sum of the time between the source and orthogonal extraction pulses, $t_{oe}$, and the time the ion spends in the orthogonal TOF section, $$t_{orth}-t_{det}=t_{oe}+t_{orth} \tag{17}$$

The time of orthogonal extraction is the same for all ions, but the time spent in the orthogonal section of the instrument depends only on the m/z of the product ion. This time is a function of the effective length of the orthogonal flight path $L_{orth}$ and the orthogonal velocity vector $V_{orth}$. Since the orthogonal extraction is constant energy, $v_{orth}$ will be given by equation 2. Thus, $$t_{orth} = \frac{L_{orth}}{v_{orth}} = \frac{L_{orth}}{1.39x10^4\left(\frac{v_{orth}}{(m/z)_{prod}}\right)^{\frac{1}{2}}} \tag{18}$$

where $V_{orth}$ is the value of the extraction field experienced by the product ions. From equations 16 and 17, we see that the time of detection is a function of the product ion m/z and is independent of the precursor m/z value.

$$(m/z)_{prod} = V_{orth}\left(\frac{1.39x10^4(t_{det}-t_{oe})}{L_{orth}}\right)^2 \tag{19}$$

However, the location of the product ion at the time of orthogonal extraction and the value of its horizontal velocity vector depend only on the precursor m/z. The position at which the ion is detected is the sum of the horizontal extraction position and the additional horizontal distance $D_{orth}$ it moved while in the orthogonal section. This latter term will depend on the product ion m/z. Thus $$\begin{aligned} D_{det} &= D_{oe} + D_{orth} \\ &= 1.39x10^4 t_{oe}\left(\frac{V_{ext}}{(m/z)_{prec}}\right)^{\frac{1}{2}} + t_{orth}v_{prec} \\ &= 1.39x10^4 t_{oe}\left(\frac{V_{ext}}{(m/z)_{prec}}\right) + \frac{L_{orth}\left(\frac{V_{ext}}{(m/z)_{prec}}\right)^{\frac{1}{2}}}{\left(\frac{V_{orth}}{(m/z)_{prod}}\right)^{\frac{1}{2}}} \end{aligned} \tag{20}$$

and $$(m/z)_{prec} = Vext\left(\frac{1.39x10^4 t_{det}}{D_{det}}\right)^2 \tag{21}$$

Equations 18 and 20 demonstrate that for each ion detected, the precursor m/z and the product m/z can be uniquely determined from a measurement of the detector position and the detection time.

Figure 10:
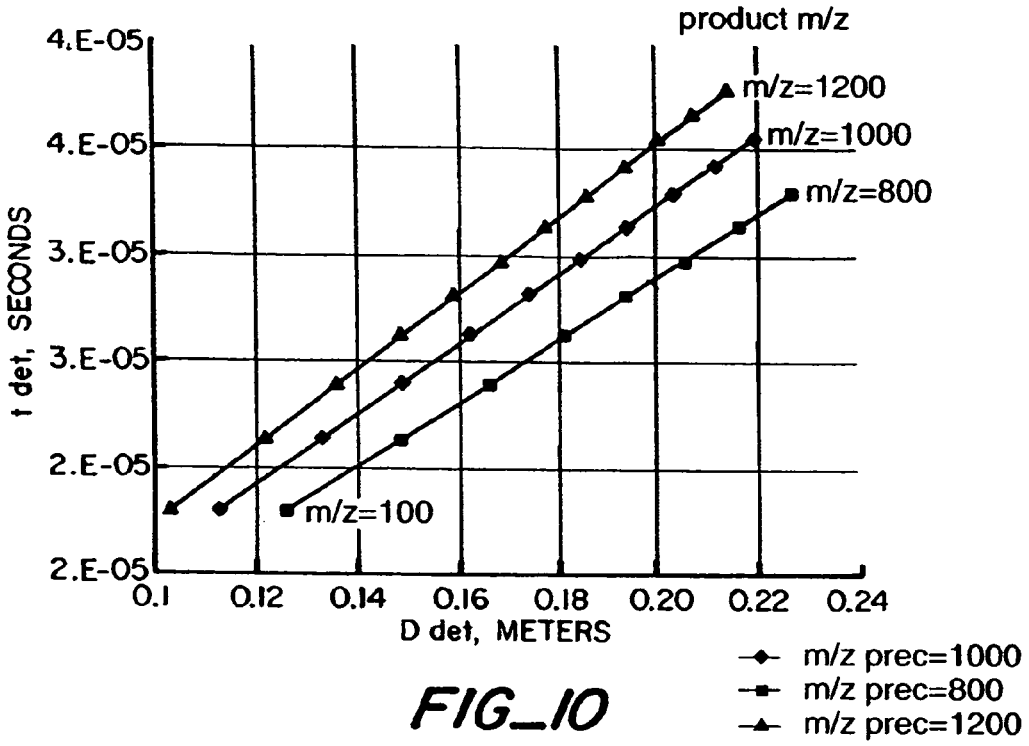
FIG. 10 shows a graphical representation of detection time plotted against detector position for product ions for one set of operating parameters in the system of FIG. 9.

The points made by the equations derived above are further illustrated in FIG. 10. Here, the detection time is plotted against detector position for product ions every 100 m/z values derived from precursor ions of m/z 800, 1000, and 1200 Daltons. The values assumed in this calculation were 200 V and 2000 V for $V_{ext}$ and $V_{orth}$, an orthogonal extraction time of 10 μs and an orthogonal flight path equivalent to 0.5 meters. All the product ions fall on the same straight line from a given precursor m/z value as seen from equation 20 where, for a given value of $(m/z)_{prec}$, the ratio of $t_{det}$ to $D_{det}$ is a constant.

The calculation shown above assumed a constant energy acceleration of ions from the ion source. As indicated above, a ramped extraction voltage may provide improved performance and a more compact detection region with constant spacing between adjacent m/z values. Implementation of such an extraction field will affect the relationship shown in Equation 20, but the unique position in the distance-time field for each combination of precursor m/z and product m/z value will be maintained.

Ion Fragmentation Cell

An important aspect of the representation of an ion fragmentation cell in FIG. 9 is its position following extraction of the precursor ions from the source and before the region where the orthogonal extraction field is applied. It is important that the fragmentation energy be applied in a way that does not involve significant momentum transfer to the excited ion. This can be accomplished through the use of higher energy ionization which can create metastable ions that can decompose spontaneously in the field-free region between the source and orthogonal extraction. Such ions are commonly produced by the MALDI method of ionization.

In cases where stable ions are produced in the source, these ions must be excited to cause fragmentation in some way. It is essential that the particles used for excitation have very low mass in order to avoid changing the precursor-dependent velocity that is part of the DOF determination of precursor ion m/z. This is perfectly accomplished by the use of photons (Vanderhart 1992). Photon excitation can occur with photons in the infrared region (Little, Speir et al. 1994; Stephenson, Booth et al. 1994; Price, Schnier et al. 1996; Payne and Glish 2001) or in the visible-ultraviolet region (Gimonkinsel, Kinsel et al. 1995; Guan, Kelleher et al. 1996). Photons fragmentation efficiency can be increased through the use of a mirrored fragmentation chamber so that each photon will traverse the ion flight path multiple times so as to increase its probability of its being absorbed by a precursor ion.

Another possibility is the use of an energetic electron beam instead of the light source. Introduction of the electrons without a disturbing electric field would be a challenge. Collision-induced dissociation can be used in the high-energy mode where energy transfer is accomplished with a minimum of momentum transfer.

Orthogonal Extraction TOF

In the orthogonal extraction section of the instrument, the ions are given a vector of motion that is orthogonal to their trajectory from the ion source. As is standard with orthogonal extraction instruments, the acceleration mode used is constant energy though a time-dependent extraction field is not ruled out. The orthogonal velocity imparted to the ions in this section depends on the product ion m/z. The orthogonal section can be "linear", that is, have a detector at the end of the orthogonal flight path, or it can include an ion mirror. Both possibilities are shown in FIG. 9. If an ion mirror is used, it will have an effective length which is then used as $L_{orth}$. In general, an ion mirror provides better product ion resolution in a smaller space (Kerley 1998; Doroshenko and Cotter 1999; Berkout, Cotter et al. 2001).

A significant difference from the normal orthogonal TOF section used in many existing instruments is the axial length of the orthogonal acceleration region. It must be long enough to incorporate the ion positions over the full range of m/z values of interest at the time of extraction. In addition, the optional ion mirror must provide accurate reflection and space focus for ions over this full length of the flight path. A wide-aperture mirror will be required for this application.

Array Detector

The detector array shown in FIG. 9 is a series of detectors arranged in a linear array. Each detector is connected to an electronic device which can record the ion intensity at the detector as a function of time. These devices can be either analog-to-digital converters (ADC) or time-to-digital converters (TDC). In this way, all the points in the two dimensions of time and distance can be detected and the precursor and product m/z values of all ions detected can be calculated.

The ion flight time is solely a function of the product ion m/z since all ions are orthogonally extracted at the same time but with m/z-dependent velocities. An ion's axial distance depends on the precursor ion velocity and the total flight time. A derived plot of the total flight time and axial distance for products of three different precursor ion m/z values is shown in FIG. 10.

Figure 11:
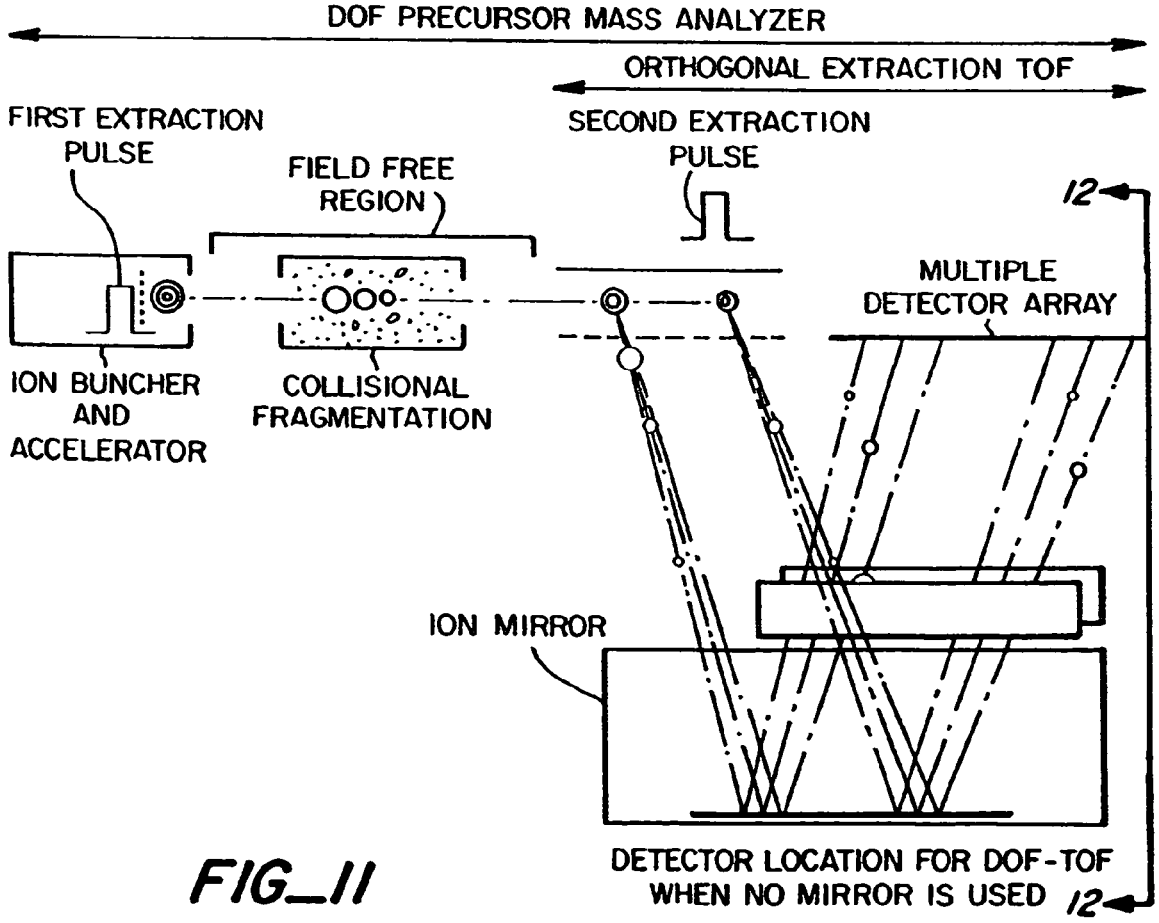
FIG. 11 shows a schematic representation of the combination of DOF and TOF mass spectrometers where the TOF has been converted to transverse distance by a sweep voltage applied to the deflection plates in accordance with the invention.
Figure 12:
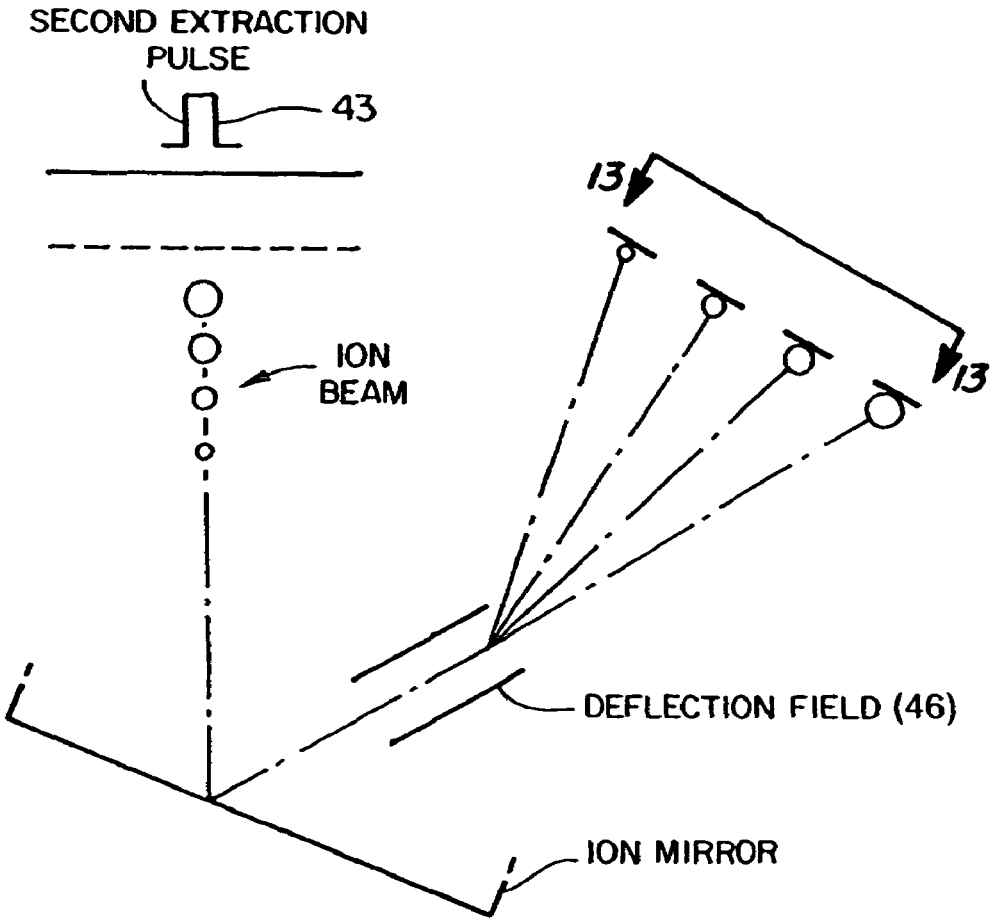
FIG. 12 is an end view of the mass spectrometer of FIG. 11 taken along the line 12-12 of FIG. 11.
Figure 13:
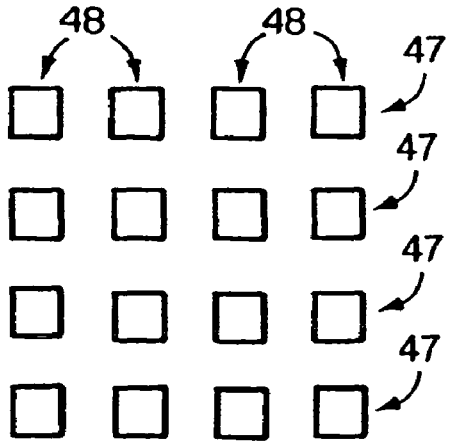
FIG. 13 is a plan view of the detector array taken along the line 13-13 of FIG. 12.

FIGS. 11, 12 and 13 show a mass spectrometer in which ions with various axial distances of flight and orthogonal velocities are detected with a two-dimensional X-Y detector array. The ion bundles are subjected to a second extraction pulse just as in the described DOF-TOF instrument where the ions are detected by their axial position and by their time of flight. However, in this embodiment the ions pass through deflection plates 46 which have a time-dependent deflection voltage applied. The deflection is in the other orthogonal direction (into the paper on which FIG. 11 is printed). Ions of smaller m/z value, emerging from the ion mirror first, are deflected by a smaller field than ions of larger m/z value emerging later. Thus ions are deflected at an angle that is m/z dependent so that ions of different m/z will fall on different parts of the two-dimensional detector array. Referring particularly to FIG. 13 showing the positions of the detectors in the two-dimensional array, the rows of detectors 47 would correspond to various distances of flight (precursor m/z and product m/z dependent) while the columns 48 in each array would correspond to different angles from time-dependent deflection field 46 and thus different times of flight (product m/z dependent). The read out of the two-dimensional detector array represents a three dimensional mass analysis (precursor ion mass: fragment ion mass: intensity).

Figure 14:
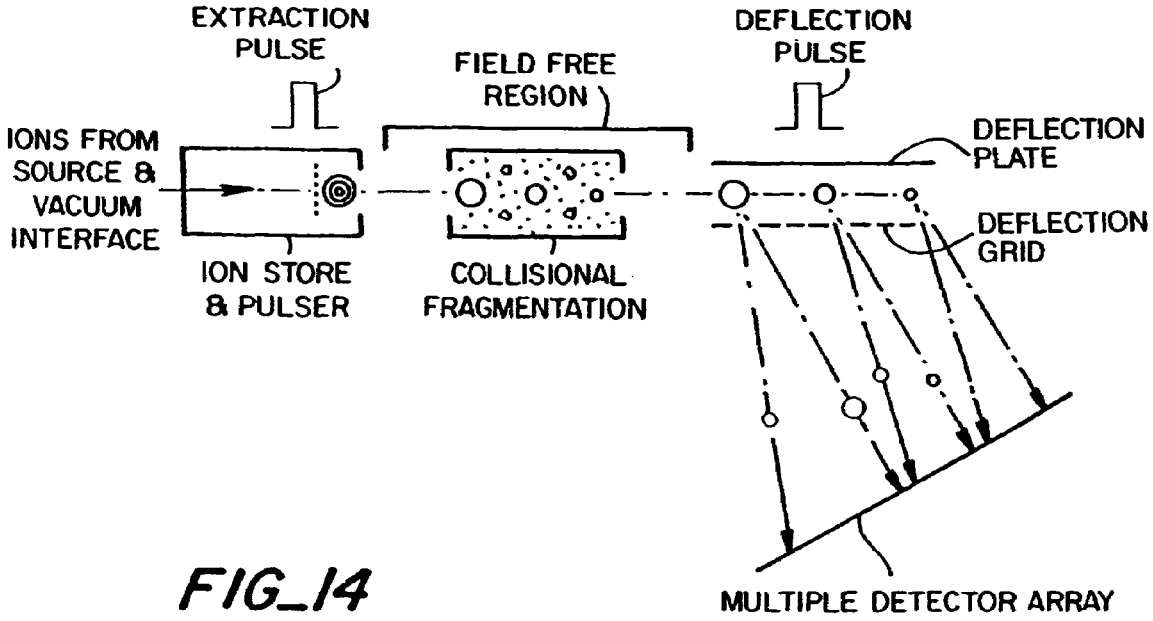
FIG. 14 shows a schematic representation of a DOF precursor and fragment analyzer.
Figure 15:
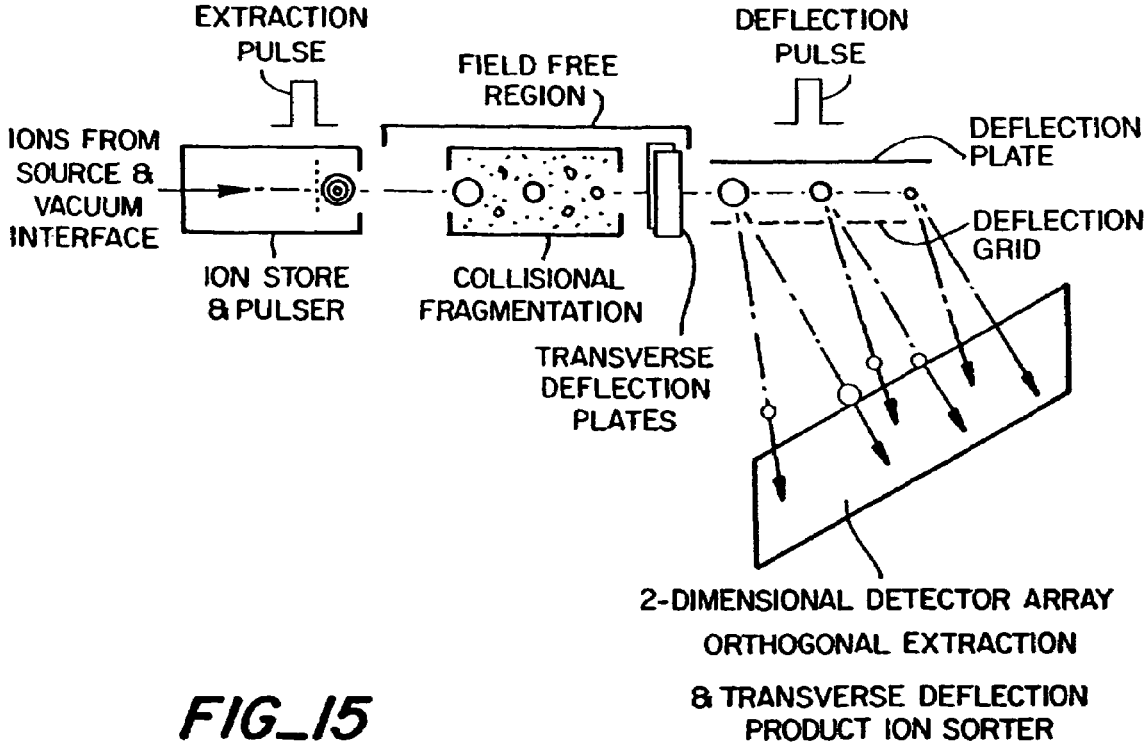
FIG. 15 is a schematic representation of another DOF precursor and fragment analyzer.

FIGS. 14 and 15 illustrate an alternate implementation of DOF-MS in the achievement of simultaneous MS/MS. Consider the arrangement shown in FIG. 14. As seen and earlier predicted, after orthogonal acceleration, the product ions will have a different trajectory from their precursor ions due to their different orthogonal velocities. These product ions will then appear at different points on the detector array from their precursor ions. It is desirable to distinguish the product ion detection from that of the precursors. This could be done in the third dimension by imparting an ion motion in the transverse (into and out of the paper) dimension that is dependent on the product ion m/z value. Since the orthogonal energy vectors of all the ions are the same, an electrostatic deflector set horizontally will affect all the ions the same with no net resolution. The deflecting plates must therefore be set vertically. This can be done before, coincidentally with, or after the orthogonal deflection. A preferred implementation is shown in FIG. 15 with the transverse deflection plates located before the orthogonal deflection plates. This transverse deflection field can be constantly applied. It is also understood that the average voltage applied to the plates must be the same potential as that of the field free region.

These calculations and examples show clearly that an MS/MS mass spectrometer that enjoys simultaneous detection of all product ions for all precursor ions in the source is practical. Such an instrument benefits MS/MS mass spectrometry in areas of application where full spectra must be taken in order to obtain the desired information. Examples of such applications would be in searching for biological modifications related to disease or drug metabolism. Another example is where one is looking for the difference in the chemical composition between two environments such as a healthy body and one that is not. It would be useful for drug screening for biological activity where the specific nature of that activity is not known.

It is significant that all the data that are available from the three types of MS/MS scans are available in each 3-dimensional spectrum obtained. These three scan types are the product scan (all the products of a particular precursor), the precursor scan (all the precursors that produce a particular product), and the neutral loss scan (all the precursors that undergo a particular m/z change upon fragmentation). The product ion scan is inherent in all MS/MS instruments employing a batch mass analyzer in the second stage of mass analysis. However, the last two scans, available in the popular Q-TOF or ITMS mass spectrometers, are achieved only by scanning the quadrupole precursor mass analyzer (Chemushevich and Thompson 2001). The precursor and neutral loss scans enable the researcher to search for chemical or biochemical reaction products for which the fragmentation would produce a particular product m/z or loss of a particular neutral mass. Many applications were developed for such scans but are now largely overlooked because scanning the precursor mass analyzer is too inefficient by modern standards.

There has been long felt need for a simultaneous 2-d dispersion (McLafferty, 1983). Attaining such a dispersion is desirable for reaching the efficiency goals mentioned previously in the present application. The present invention attains such dispersion. Indeed, the information available from an MS/MS instrument is essentially 3-dimensional in nature. Such information may be used in a plot of Intensity vs. precursor m/z vs. product m/z. Dispersion along only one axis can only give intensity along that axis. To obtain the full 3 dimensions, one must have 2-d dispersion or repeat the process enough times to fill in the second dimension. The present invention enables simultaneous 2-d dispersion.

There are many further advantages to such an MS/MS instrument of the present invention that attains simultaneous 2-d dispersion. It is simple in construction. It avoids the need for high speed electronics in the detection system (when the timed sweep in the orthogonal section is used with the 2-dimensional array detector or in the case of the transverse acceleration). The 2-dimensional detectors could be integrating devices for the accumulation of the results of many ions extractions from the source which would provide improved signal-to-noise ratio and wider dynamic range. The instrument may be very compact, potentially bringing its great resolving power and huge data production rate to the field for a variety of environmental and security applications.

While the foregoing description and drawings represent the preferred embodiments of the present invention, it will be understood that various changes and modifications may be made without departing from the spirit and scope of the present invention.

REFERENCE SOURCES

Alderdice, D. S., P. J. Derrick and D. J. Jardine (1993). Tandem mass spectrometry based on time of flight analyzer. USA, Unisearch Limited, Kensington, Australia.

Barofsky, D. F. (2002).

Tandem time of flight mass spectrometer. USA, State of Oregon, Oregon State University.

Bateman, R. H. and J: B. Hoyes (2000). Methods and apparatus for tandem mass spectrometry. USA, Micromass, UK.

Berkout, V. D., R. J. Cotter and D. P. Segers (2001). "Miniaturized EI/Q/oa TOF mass spectrometer." *Journal of the American Society for Mass Spectrometry* 12(6): 641 647.

Chemushevich, I. V., W. Ens and K. G. Standing (1999). "Orthogonal Injection TOFMS for Analyzing Biomolecules." Analytical Chemistry 71 (July 1): 452A 461A.

Chemushevich, I. V. and B. Thompson (2001). MS/MS scan methods for a quadrupole/time of flight tandem mass spectrometer. USA, MDS, Inc. Canada.

Conzemius, R. J. and H. J. Svec (1990). "A New Concept for Characterizing Peptides and Proteins Using a Modified Mass Spectrometric Approach." *International Journal of Mass Spectrometry and Ion Processes* 103(1): 57 66.

Cotter, R. J. (1999). "The new time-of-flight mass spectrometry." *Analytical Chemistry* 71(13): A445-A451.

Doroshenko, V. M. and R. J. Cotter (1999). "Ideal velocity focusing in a reflectron time of flight mass spectrometer." *Journal of the American Society for Mass Spectrometry* 10(10): 992 999.

Fischer, S. M., C. A. Flory and K. D. Henry (1999). Statially resolved electrical deflection mass spectrometry. USA, Hewlett Packard Co.

Gimonkinsel, M. E., G. R. Kinsel, R. D. Edmondson and D. H. Russell (1995). "Photodissociation of High Molecular Weight Peptides and Proteins in a 2 Stage Linear Time of Flight Mass Spectrometer." *Journal of the American Society for Mass Spectrometry* 6(7): 578 587.

Guan, Z. Q., N. L. Kelleher, O. C. PB, D. J. Aaserud, D. P. Little and F. W. McLafferty (1996). "193 nm photodissociation of larger multiply charged biomolecules." *International Journal of Mass Spectrometry and Ion Processes* 158: 357 364.

Kerley, E. L. (1998). Miniaturized time of flight mass spectrometer. USA.

Kovtoun, S. V. and R. J. Cotter (2000). "Mass-correlated pulsed extraction: Theoretical analysis and implementation with a linear matrix-assisted laser Desorption/ionization time of flight mass spectrometer." *Journal of the American Society for Mass Spectrometry* 11(10): 841-853.

Linden, H. B. (1995). Mass spectrometer for time dependent mass separation. USA.

Little, D. P., J. P. Speir, M. W. Senko, P. B. Oconnor and F. W. McLafferty (1994). "Infrared Multiphoton Dissociation of Large Multiply Charged Ions for Biomolecule Sequencing." *Analytical Chemistry* 66(18): 2809 2815.

McLafferty, F. W. *Tandem Mass Spectrometry*, John Wiley and Sons, New York, 1983, p. 6.

Oron, M. and Y. Paiss (1976). Dynamic Mass Spectrometer. USA, The University of Rochester, N.Y.

Payne, A. H. and G. L. Glish (2001). "Thermally assisted infrared multiphoton photodissociation in a quadrupole ion trap." *Analytical Chemistry* 73(15): 35423548.

Price, W. D., P. D. Schnier and E. R. Williams (1996). "Tandem mass spectrometry of large biomolecule ions by blackbody infrared radiative dissociation." Analytical Chemis 68(5):859 866.

Reinhold, B. B. and A. N. Verentchikov (2002). Multiple stage mass spectrometer. USA, University of New Hampshire.

Roussis, S. G. (2001). "Automated tandem mass spectrometry by orthogonal acceleration TOF data acquisition and simultaneous magnet scanning for the characterization of petroleum mixtures." *Analytical Chemistry* 73(15): 3611 3623.

Sinha, M. P. (1998). Array detectors for simultaneous measurement of ions in mass spectrometry. USA, California Institute of Technology.

Stephenson, J. L., M. M. Booth, J. A. Shalosky, J. R. Eyler and R. A. Yost (1994). "Infrared Multiple Photon Dissociation in the Quadrupole Ion Trap Via a Multipass Optical Arrangement." *Journal of the American Society for Mass Spectrometry* 5(10): 886 893.

Vanderhart, W. J. (1992). "Studies of Ion Structures by Photodissociation." *International Journal of Mass Spectrometry and Ion Processes* 118: 617 633.

Van Fong, C. W. "Phase Space Dynamics in a Linear RFQ Trap for Time-of-Flight Mass Spectrometry", Thesis, Department of Physics, McGill University, Montreal, Canada, January, 2001.

Whitehouse, C. M. and B. Andrien (2001). Mass spectrometry from surfaces. USA, Analytica of Branford.

Wollnik, H. (1993). Time of flight mass spectrometer as the second stage for a tandem mass spectrometer. USA.

What is claimed is:

1. A mass analyzer including:

a. an ion storage device for receiving and storing ions;

b. a means for applying an ion extraction voltage pulse to said storage device to accelerate the ions whereby ions leaving the storage means have mass-to-charge ratio dependent velocities;

c. a field free region through which the ions of different mass-to-charge ratios travel different distances in a predetermined time, and d. detectors spaced to receive the ions of different mass-to-charge ratios which have traveled different distances in a predetermined time and provide outputs indicative of the relative abundance of ions striking the detector.

2. A mass analyzer as in claim 1 including an ionizer for receiving a sample to be analyzed and form the ions which are received by the ion storage device.

3. A mass analyzer as in claims 1 or 2 in which the said outputs indicative of the relative abundance of ions striking the detector are derived from detectors positioned to receive ions of particular mass-to-charge ratios.

4. A mass analyzer as in claim 1 or 2 including a deflector for deflecting ions traveling in said field free region in an orthogonal direction towards said detectors.

5. A mass analyzer as in claim 1 or 2 including means for dissociating or changing the mass-to-charge ratio of said ions in said field free region into product ions so that said product ions travel at substantially the same velocity as their precursor ions and means for applying an orthogonal accelerating voltage pulse to said product ions and precursor ions whereby the unchanged precursor and product ions of different mass-to-charge ratios travel at different velocities, said detector arranged to detect the unchanged precursor and product ions and providing a mass spectrum in which the mass-to-charge ratios of the product ions and their precursor ions arc both identified.

6. A mass analyzer as in claim 5 in which the product ions are detected by time-of-flight detectors.

7. A mass analyzer as in claim 5 which includes means for applying an orthogonal field to said product ions to deflect the ions, and said detectors are positioned to enable position dependent detection.

8. A mass analyzer as in claim 5 which includes means for applying a transverse deflection field to the ion stream after the formation of product ions so that precursor and product ions are separated transversely according to their mass-to-charge ratios.

9. A mass analyzer as in claim 8 in which said means for applying a transverse deflection field is positioned before the orthogonal acceleration region.

10. A mass analyzer as in claim 8 in which said means for applying a transverse deflection field is positioned after the orthogonal acceleration region.

11. A mass analyzer as in claim 8 in which the ions spread axially according to their precursor mass-to-charge ratio and transversely according to their product mass-to-charge ratio are detected using a two-dimensional away of ion detectors.

12. The method of mass analyzing an ion stream which comprises the steps of: trapping ions in an ion storage device; applying a longitudinal extraction voltage to the storage device whereby ions having smaller mass-to-charge ratios travel at a greater velocity than ions of a larger mass-to-charge ratio; allowing said ions to travel for a predetermined time in a field free region whereby they travel different distances; detecting the ions of different mass-to-charge ratio with detectors which are spaced substantially parallel to the line of travel; and recording the intensity of the detectors as a function of time to obtain a time-dependent profile of ion intensity.

13. The method of analyzing a stream of ions of different mass-to-charge ratios which compromises the steps of: receiving and storing a predetermined number of said ions; accelerating said stored ions whereby ions of different mass-to-charge ratios attain different velocities; and determining the mass-to-charge ratios of said ions by the distance traveled by ions of different mass-to-charge ratio in a predetermined time.

14. The method of mass analyzing a stream of ions of different mass-to-charge ratios comprising the steps of: directing said ion stream to an ion storage means; periodically applying an extraction voltage to said storage means to extract ions from said storage means with a velocity that is dependent upon the mass-to-charge ratio of said ions; allowing said ions to travel through a field free region; and detecting said ions with ion detectors spaced to receive ions of different mass-to-charge ratio which have traveled different distances in a predetermined time.

15. The method of claim 12 which includes the additional step of dissociating said ions in the field free region whereby to form bundles of fragment ions having the same velocity as the precursor ions and thereafter applying an orthogonal voltage pulse to said bundles to cause the fragment ions to attain a velocity which is dependent upon their mass-to-charge ratio and, detecting said fragment ions and providing information regarding their mass-to-charge ratios and that of their precursor ions.

16. A method as in claim 11 in which the fragment ions are detected by detecting their time-of-flight.

17. A method as in claim 15 in which the fragment ions are detected by detecting their distance of travel at a predetermined time after the orthogonal pulse.

18. A mass spectrometer comprising, an ion storage device; an extractor that is configured and arranged to provide a pulsed extractor field to extract and accelerate a bunch of ions from the ion storage device to accelerate ions of smaller mass-to-charge ratio at a greater velocity than ones of larger mass-to-charge ratio, a field free region through which the ion bunch travels for a predetermined time whereby the ions with different mass-to-charge ratios travel different distances, a plurality of separate detectors spaced from the acceleration region each by respective distances that differ from each other and; a lateral accelerator configured and arranged to generate a lateral field within the free region that causes the ions to change their direction of travel laterally to reach adjacent ones of the separate detectors, the separate detectors being configured and arranged to detect ion intensity of the smaller and larger mass-to-charge ratio ions that reach them; wherein the separate detectors are arranged non-parallel to the line of travel.

19. A mass spectrometer of claim 18, wherein the plurality of separate detectors present the ion intensities in reverse order of distance of the separate detectors from the extraction region to produce a mass spectrum.

20. A mass spectrometer of claim 18, wherein each of the separate detectors is configured to accumulate ion charges over a period of time.

21. A mass spectrometer of claim 18, wherein the mass analyzer is configured to operate to store and accelerate in bunches sequentially in time.

22. A mass spectrometer of claim 18, wherein an ion fragmentation cell is within the field free region in the path of the accelerated ion bunch and configured to dissociate said ions to form ion fragments, wherein said lateral accelerator accelerates the ions of smaller mass-to-charge charge ratio to a greater velocity than the ions of larger mass-to-charge ratio and wherein said detectors are configured to measure the times-of-flight of the ions after they are laterally accelerated to detect the fragment ions whereby to provide information regarding the fragment ions and their precursors.

23. A mass spectrometer of claim 22, wherein the ion dissociation energizes precursor ions of the ion stream by collision with a neutral gas molecule to induce the dissociation.

24. A mass spectrometer of claim 22, wherein the fragmentation cell applies fragmentation energy to the ion stream that avoids substantial momentum transfer to the fragment ions.

25. A mass spectrometer of claim 18, wherein the separate detectors are ranged relative to each other so that a position of each ion's detection has a square root relation to mass-to-charge ratio of that ion.

26. A mass spectrometer of claim 18, wherein the extraction field generated by the extractor is derived from an extraction voltage that increases in magnitude with time.

27. A mass spectrometer of claim 18, wherein the extraction field generated by the extractor is derived from an extraction pulse whose shape varies.

28. A mass spectrometer of claim 18, further compromising a fragmentation section arranged to fragment the ion stream, an orthogonal time of flight section arranged to sort the ions of the fragmented ion stream according to mass to charge ratio values said detectors arranged to detect time of arrival of the sorted ions.

29. A mass spectrometer of claim 22, further comprising a fragmenter that applies an intense, energetic beam of light, timed to coincide with appearance of ions reaching the fragmentation cell.

30. A mass spectrometer of claim 22, including a deflector providing a deflection field to the fragment ions so that they are separated by distance of flight and wherein the detector away comprises a two-dimensional array to detect affival of the ions and provide the mass-to-charge ratio of the ion fragments for each ion.

31. A mass analyzer as in claim 1 further comprising at least one ion optic element between the means for applying the ion extraction voltage pulse and the detectors.

32. A mass analyzer as in claim 31 wherein the ion optic element is configured for ion containment.

33. A mass analyzer as in claim 31 wherein the ion optic element is configured for ion focusing.

34. A mass analyzer as in claim 1 further comprising a fragmentation cell.

35. A mass analyzer as in claim 34 wherein the fragmentation cell is operative.

36. A mass analyzer as in claim 34 wherein the fragmentation cell is inoperative.

37. A mass analyzer as in claim 1 further comprising a means for applying an orthogonal extraction pulse.

38. A mass analyzer as in claim 1 further comprising timing circuits configured to control the timing of the orthogonal extraction pulse relative to the ion extraction pulse.

* * * * *